US007914902B2

(12) United States Patent
Kao et al.

(10) Patent No.: US 7,914,902 B2
(45) **Date of Patent: *Mar. 29, 2011**

(54) THERMAL MODULE

(75) Inventors: Ying Hung Kao, Tainan (TW); Emily Hsiao, Tainan (TW)

(73) Assignee: Jiing Tung Tec. Metal Co., Ltd., Tainan (TW)

( * ) Notice: Subject to any disclaimer, the term of this patent is extended or adjusted under 35 U.S.C. 154(b) by 719 days.

This patent is subject to a terminal disclaimer.

(21) Appl. No.: 11/979,563

(22) Filed: Nov. 6, 2007

(65) Prior Publication Data

US 2009/0117402 A1 May 7, 2009

(51) Int. Cl.
*F21V 29/00* (2006.01)

(52) U.S. Cl. ..... 428/598; 428/600; 165/80.3; 165/185; 174/548; 439/487; 362/373

(58) Field of Classification Search ..... None
See application file for complete search history.

(56) References Cited

U.S. PATENT DOCUMENTS

| | | | | |
|---|---|---|---|---|
| 6,982,518 | B2 * | 1/2006 | Chou et al. | 313/46 |
| 7,744,259 | B2 * | 6/2010 | Walczak et al. | 362/421 |
| 7,845,393 | B2 * | 12/2010 | Kao et al. | 165/80.3 |
| 2001/0020498 | A1 * | 9/2001 | Seki et al. | 148/420 |
| 2009/0109625 | A1 * | 4/2009 | Booth et al. | 361/702 |
| 2009/0117316 | A1 * | 5/2009 | Kao et al. | 428/66.6 |
| 2009/0129102 | A1 * | 5/2009 | Xiao et al. | 362/373 |

FOREIGN PATENT DOCUMENTS

| | | |
|---|---|---|
| JP | 5-305380 | * 11/1993 |
| JP | 6-248402 | * 9/1994 |
| JP | 09-263871 | * 10/1997 |
| JP | 11-077214 | * 3/1999 |
| JP | 2000-135538 | * 5/2000 |
| JP | 2000-246414 | * 9/2000 |
| JP | 2001-26835 | * 1/2001 |
| JP | 2001-269746 | * 10/2001 |
| JP | 2002-254115 | * 9/2002 |
| JP | 2002-361352 | * 12/2002 |
| WO | WO 2006/075812 | * 7/2006 |

* cited by examiner

*Primary Examiner* — John J Zimmerman
(74) *Attorney, Agent, or Firm* — Guice Patents PLLC

(57) ABSTRACT

A thermal module directly press-forged from magnesium alloy is disclosed having a peripheral wall, a recessed chamber surrounded by the peripheral wall. The body is made of magnesium alloy by means of softening magnesium alloy with heat and then press forging softened magnesium alloy into the desired shape.

5 Claims, 6 Drawing Sheets

THERMAL MODULE

BACKGROUND OF THE INVENTION

1. Field of the Invention

The present invention relates to thermal modules and more particularly, to a high-performance thermal module directly press-forged from magnesium alloy.

2. Description of the Related Art

Despite of different design changes, conventional lighting fixtures use a lamp bulb or lamp tube to produce light. These conventional lighting fixtures have the common drawbacks of high consumption of electric energy and production of heat. The production of heat not only shortens the service life of the lighting fixture but also increases the ambient temperature. Further, a daylight lamp causes a flashing problem that is harmful to the eyes.

Nowadays, LEDs (light emitting diodes) have been intensively used in lighting fixtures to substitute for conventional lamp bulbs and tubes for the advantages of low power consumption and long service life. Further, because LEDs do not contain mercury, using LEDs for lighting fixture brings no harm to environment.

However, LEDs may be too dim in bright light situations because of its unidirectional lighting feature. Therefore, a LED lighting fixture has the drawback of limited angle of illumination. To overcome this problem, multiple LEDs may be arranged together and set in different angles. However, this arrangement greatly complicates the fabrication of the lighting fixture and will also increase the cost. Further, LEDs still produce heat during operation. The problem of heat will affect the brightness of LEDs and their service life.

Various thermal modules have been disclosed for use with LEDs to dissipate heat during operation of LEDs. Conventional thermal modules for this purpose are commonly extruded from aluminum alloy. Radiation fins may be provided to enhance heat dissipation. However, the heat dissipation effect of conventional thermal modules extruded from aluminum alloy is still not perfect.

Further, following the market tendency toward light and small characteristics and the world's environmental protection trend, magnesium alloy has become the material market's favorite. The specific gravity of magnesium alloy is 1.7, or about ⅔ of the specific gravity 2.7 of aluminum alloy, or about 21% of the specific gravity 7.9 of steel. Therefore, magnesium alloy has light characteristic. Further, magnesium alloy has excellent strength-to-weight ratio, high stiffness, excellent impact-resistance and wear-resistance capability, and magnetic wave absorbing and shock absorbing characteristics. Nowadays, magnesium alloy is intensively used in computer, communication and consumer electronic products.

There are manufacturers trying to use magnesium alloy for making thermal modules for LED lamps. However, magnesium alloy still has the drawbacks of (1) higher cost than aluminum alloy, and (2) low flowability. Conventionally, casting and injection molding techniques are employed to fabric thermal modules from magnesium alloy. However, casting technique is not practical for making a magnesium alloy product having a thin wall. Making thermal modules from magnesium alloy by casting may encounter the problems of thermal cracking, oxidization, insufficient strength, deformation of the product upon ejection from the mold, or insufficient tightness.

SUMMARY OF THE INVENTION

The present invention has been accomplished under the circumstances in view. According to the experience of the present inventor in metal forging to press-forge metal products from gold, silver, copper, aluminum, magnesium, and etc., magnesium alloy workpiece is cooling faster than aluminum alloy workpiece during forging, and the uniformity and tightness of crystal phase structure of magnesium alloy after forging are greatly improved. It is therefore the main object of the present invention to provide a thermal module, which has a uniform and tight crystal phase structure and excellent heat dissipation efficiency. It is another object of the present invention to provide a thermal module, which is easy to manufacture.

To achieve these and other objects of the present invention, the thermal module comprises a body press-forged from a magnesium alloy material that is heated to a softened status. The body comprises a peripheral wall and a recessed chamber surrounded by the peripheral wall. Radiation fins may be provided around the peripheral wall. Further, mounting through holes may be made on the bottom wall of the body.

DETAILED DESCRIPTION OF THE PREFERRED EMBODIMENT

Referring to FIGS. 1~6, a thermal module is shown comprising a body 1. The body 1 has a peripheral wall 11 and a recessed chamber 12 surrounded by the peripheral wall 11. The body 1 is made of magnesium alloy by means of softening magnesium alloy with heat and then press forging softened magnesium alloy into the desired shape.

Figure 1:
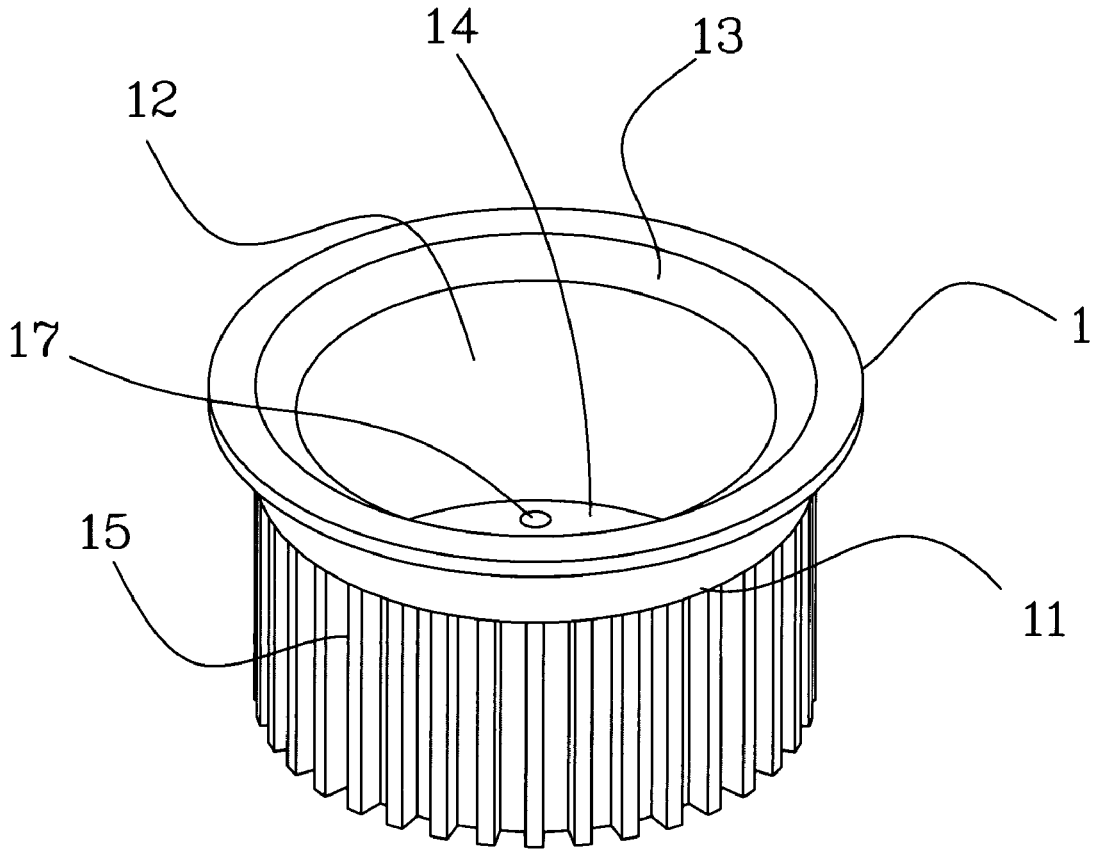
FIG. 1 is an oblique elevation of a thermal module in accordance with a first embodiment of the present invention.
Figure 2:
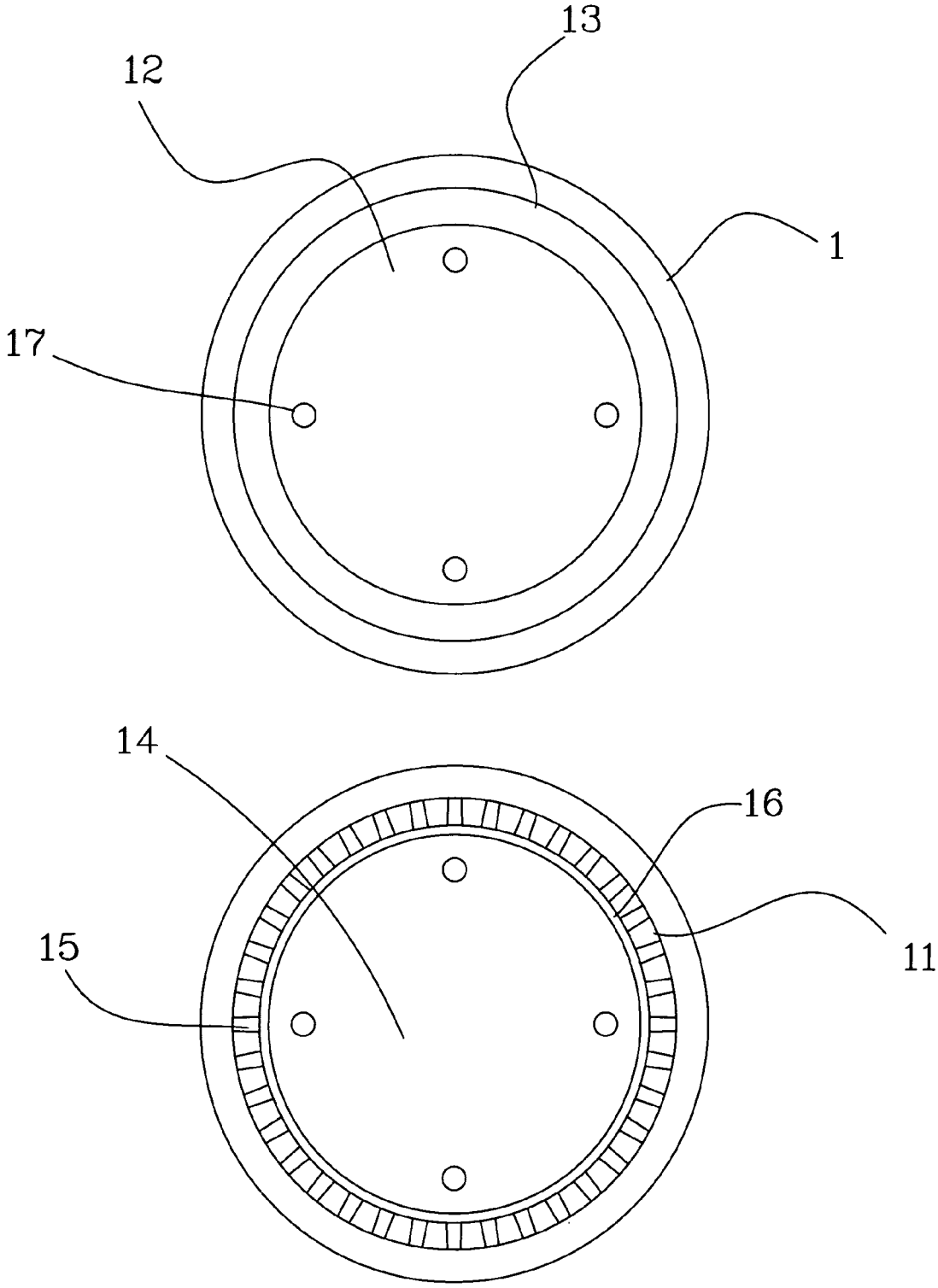
FIG. 2 is a top and bottom plain views of the thermal module in accordance with the first embodiment of the present invention.
Figure 4:
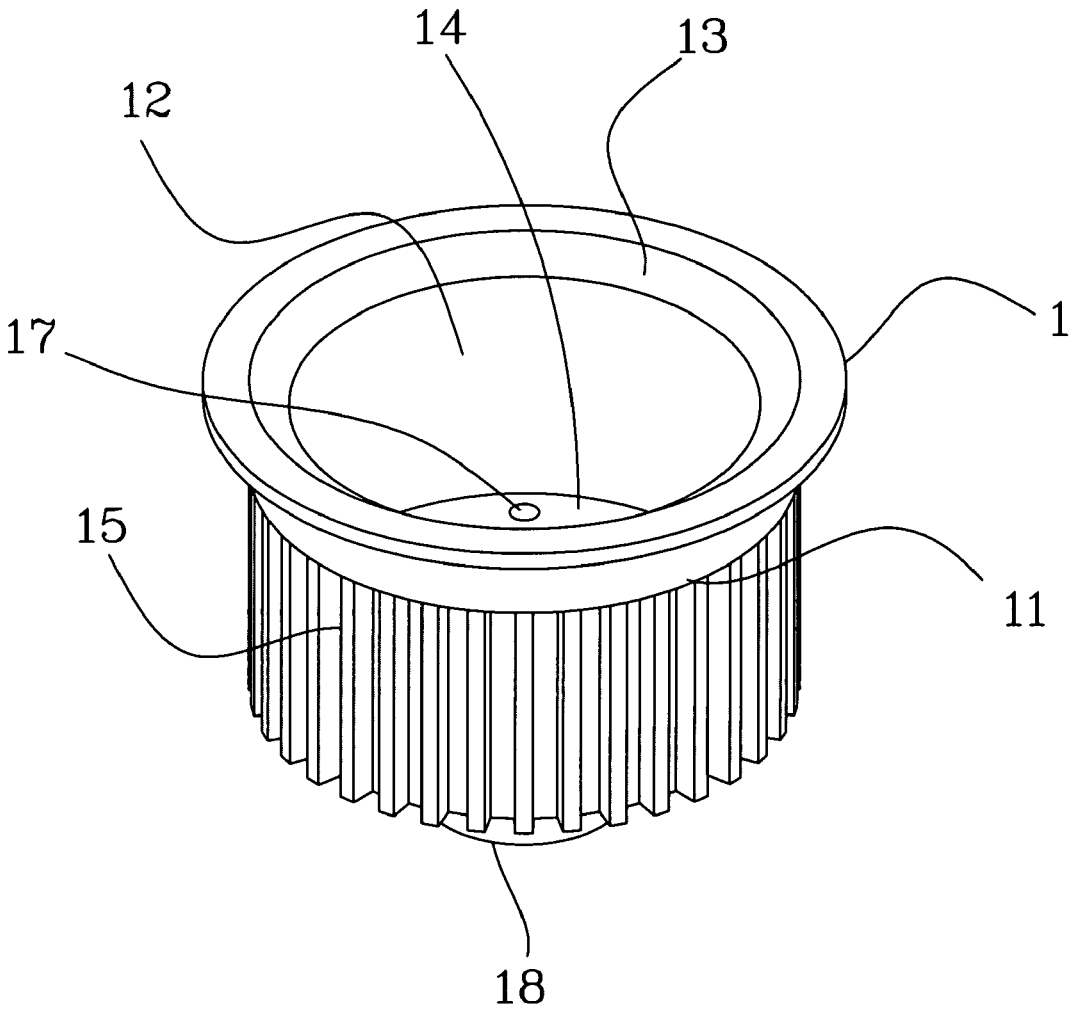
FIG. 4 is an oblique elevation of a thermal module in accordance with a second embodiment of the present invention.
Figure 5:
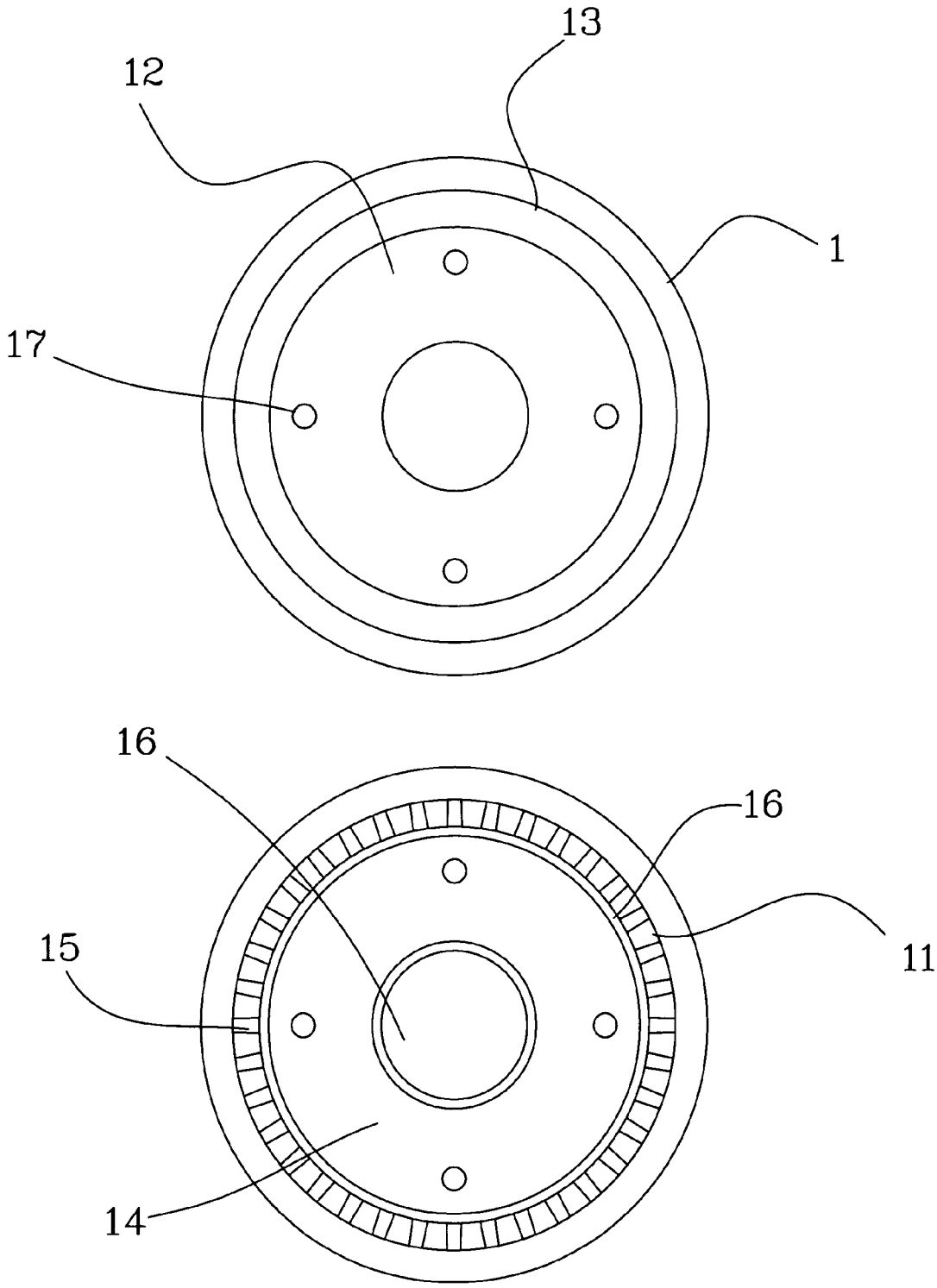
FIG. 5 is a top and bottom plain views of the thermal module in accordance with the second embodiment of the present invention.

Referring to FIGS. 1 and 2, the body 1 can be made having any of a variety of shapes such as circular, oval, triangular, rectangular, polygonal, or streamline-like shape, having an opening 13 at one side, and a base 14 at the opposite side. The base 14 has a plurality of mounting through holes 17 spaced around the border area. According to an alternate form of the present invention as shown in FIGS. 4 and 5, the body 1 has a barrel 18 downwardly extending from the center of the bottom side of the base 14.

Figure 3:
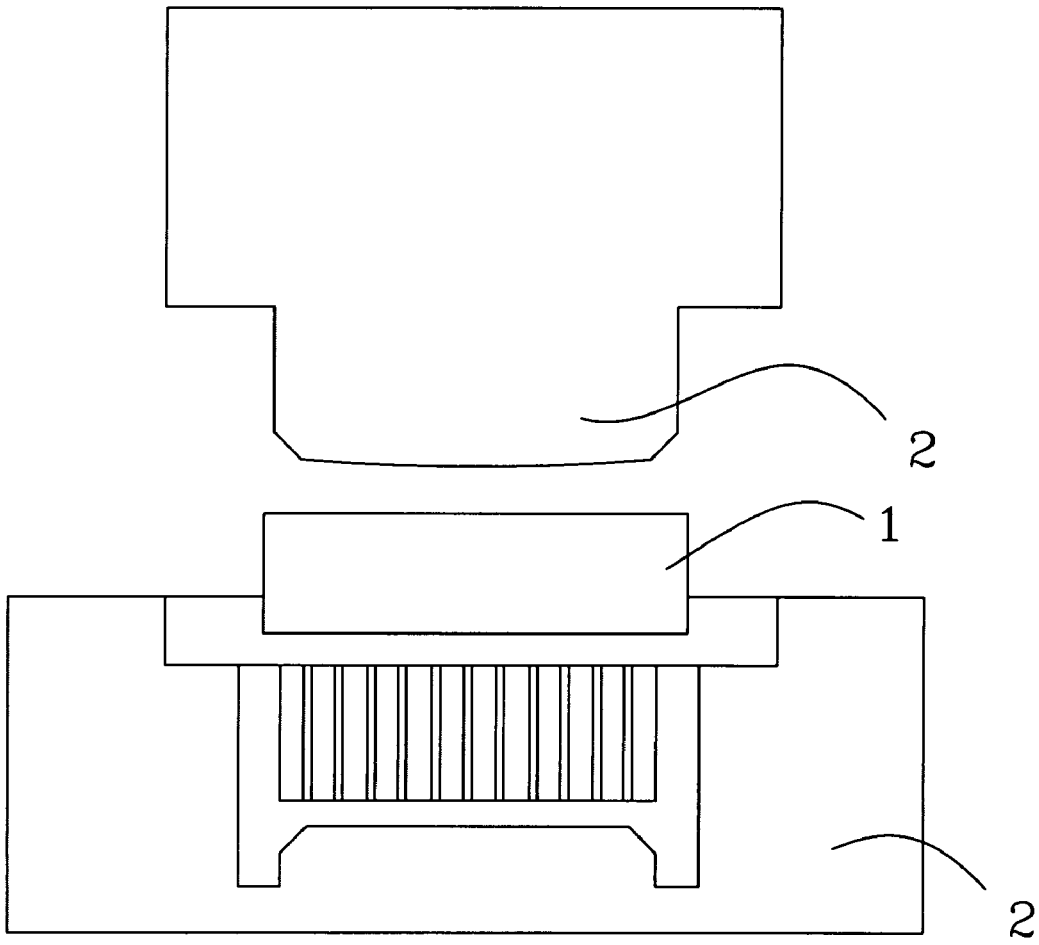
FIG. 3 is schematic drawing showing the press-forging fabrication process of the present invention.

Further, referring to FIG. 1~3, the body 1 can be made having radiation fins 15 spaced around the peripheral wall 11, and reinforcing ribs 16 at the bottom side. The said peripheral wall 11, recessed chamber 12, radiation fin 15 and reinforcing rib 16 is made of pastille shape magnesium alloy by means of softening magnesium alloy with heat and then put in the die 2, and then the softened magnesium alloy is forged into shape. This fabrication method of is quite simple, having high yield rate.

Figure 6:
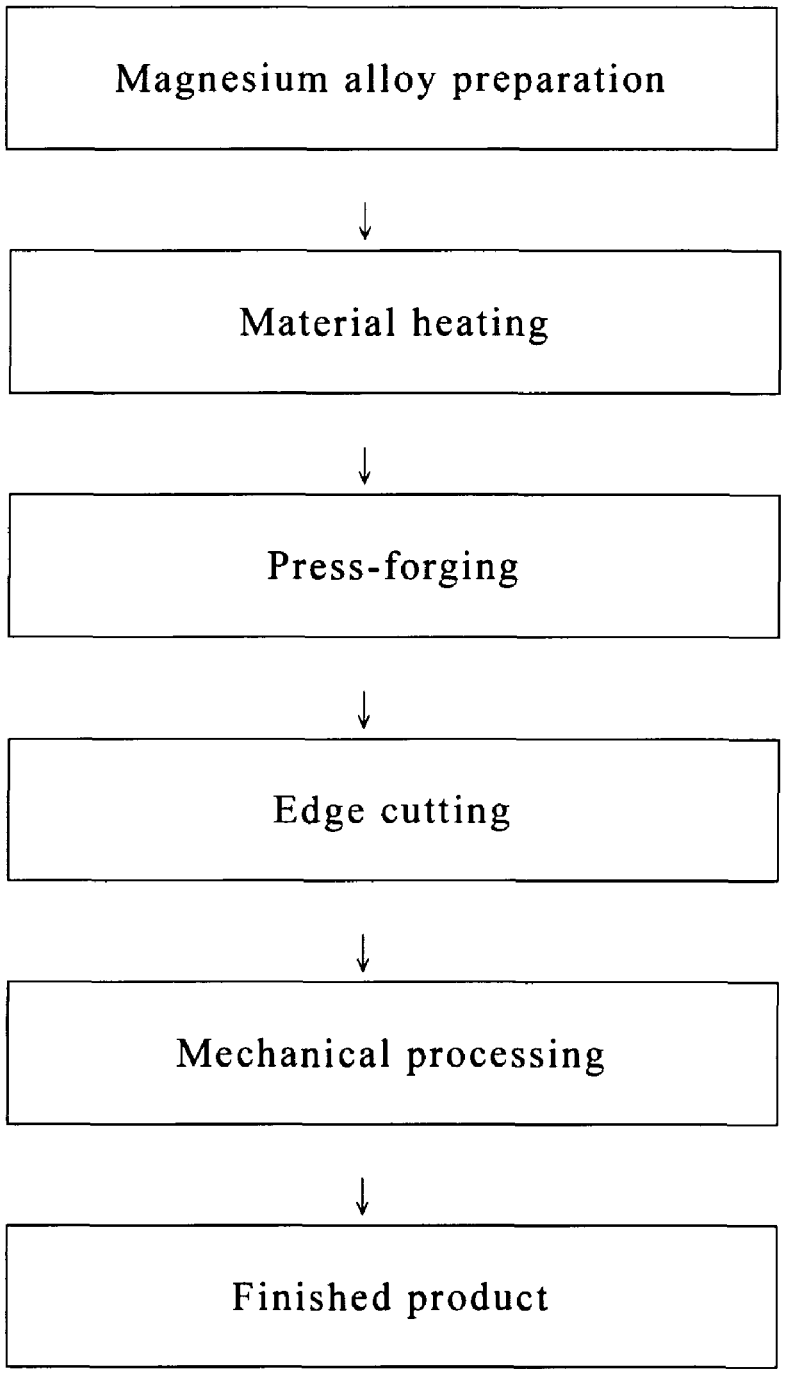
FIG. 6 is a fabrication flow of the present invention.

Referring to FIG. 6, the fabrication of the thermal module includes the steps as follows:

1. Preparing magnesium alloy material;
2. Softening prepared magnesium alloy material with heat;

3. Press-forging softened magnesium alloy material with a predetermined design of forging die;
4. Cutting the edge of the semi-finished product thus obtained; and
5. Processing the semi-finished product into the desired finished product with a mechanical processing process.

During press-forging, prepared magnesium alloy material is heated to 220°~400° C. When prepared magnesium alloy material is heated to 220°~400° C., it is softened and can easily be forged into the desired shape and thickness. After press forging, the semi-finished product has a smooth surface facilitating further surface treatment.

When the body 1 is made subject to the aforesaid fabrication procedure, the body 1 has a uniform and tight crystal phase structure having high thermal conductivity and heat dissipation capability. When tested at a predetermined power level (for example, 5 W), the heat dissipation performance of the thermal module of the present invention is much better than an aluminum alloy thermal module.

As stated above, the present invention fully utilizes the physical characteristics of magnesium alloy. A thermal module made out of magnesium alloy by means of press forging has a smooth surface convenient for further surface treatment. By means of press-forging technology, the fabrication of thermal module is easy, and the yield rate is high. Further, a magnesium alloy thermal module is superior to a conventional aluminum alloy thermal module in heat dissipation.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A thermal module comprising:

a body press-forged from a magnesium alloy material that is heated to a softened status, the body having:

a) a peripheral wall;

b) a recessed chamber surrounded by the peripheral wall;

c) an opening located at a top of the peripheral wall and communicating with the recessed chamber;

d) a base located at a bottom of the peripheral wall;

e) a plurality of radial fins located on an exterior of the peripheral wall and extending from the bottom to the top thereof; and f) at least one reinforcing rib located on a bottom side of the body.

2. The thermal module according to claim 1, wherein the peripheral wall, the recessed chamber, the plurality of radial fins, and the at least one reinforcing rib are made of a pastille shape magnesium alloy by means of softening magnesium alloy with heat and then put in the die, and then the softened magnesium alloy is forged into shape.

3. The thermal module according to claim 1, wherein the base further comprises a plurality of mounting through holes extending through and spaced around a border of the base.

4. The thermal module according to claim 1, further comprising a barrel extending downwardly from a center of the base.

5. The thermal module according to claim 1, wherein the body has a shape selected from a group of shapes consisting of a circular shape, an oval shape, a triangular shape, a rectangular shape, a polygonal shape, and a streamline shape.

* * * * *